United States Patent [19]

Nourney

[11] 4,292,875

[45] Oct. 6, 1981

[54] STRAIN-GAUGE SOUND PICKUP FOR STRING INSTRUMENT

[76] Inventor: Carl-Ernst Nourney, Am Wagenrast 6, D 4000 Düsseldorf 12, Fed. Rep. of Germany

[21] Appl. No.: 134,622

[22] Filed: Mar. 27, 1980

Related U.S. Application Data

[63] Continuation-in-part of Ser. No. 935,916, Aug. 23, 1978, Pat. No. 4,228,715.

[30] Foreign Application Priority Data

Aug. 25, 1977 [DE] Fed. Rep. of Germany ..... 2738256

[51] Int. Cl.[3] ..... G10H 3/18

[52] U.S. Cl. ..... 84/1.14; 84/1.16

[58] Field of Search ..... 84/1.04, 1.06, 1.14, 84/1.15, 1.16

[56] References Cited

U.S. PATENT DOCUMENTS

| | | | |
|---|---|---|---|
| 2,222,057 | 11/1940 | Benioff | 84/1.16 |
| 3,049,958 | 8/1962 | Benioff | 84/1.16 |
| 3,325,580 | 6/1967 | Barcus et al. | 84/1.16 |
| 3,453,920 | 7/1969 | Scherer | 84/1.16 |
| 3,530,228 | 9/1970 | Scherer | 84/1.16 |
| 3,684,814 | 8/1972 | Neustadt | 84/1.04 |
| 3,712,951 | 1/1973 | Rickard | 84/1.14 |
| 3,733,953 | 5/1973 | Ferber | 84/1.16 |
| 4,147,084 | 4/1979 | Underwood | 84/1.16 |

FOREIGN PATENT DOCUMENTS

| | | | |
|---|---|---|---|
| 931689 | 8/1955 | Fed. Rep. of Germany | 84/1.16 |

*Primary Examiner*—Stanley J. Witkowski
*Attorney, Agent, or Firm*—Karl F. Ross

[57] ABSTRACT

The strings of a musical instrument, e.g., a guitar, are individually supported on an instrument body by webs of a hard but elastic polymeric material which are free to vibrate in the longitudinal direction of the strings and carry respective strain gauges whose direction of maximum sensitivity includes an acute angle with that longitudinal direction and with the underlying body surface. The webs may be integral with or bonded onto a more massive bridge or bridge section and have gable-shaped tops carrying the strain gauges.

9 Claims, 9 Drawing Figures

STRAIN-GAUGE SOUND PICKUP FOR STRING INSTRUMENT

CROSS-REFERENCE TO RELATED APPLICATION

This is a continuation-in-part of my copending application Ser. No. 935,916 filed Aug. 23, 1978, now U.S. Pat. No. 4,228,715.

FIELD OF THE INVENTION

My present invention relates to a musical instrument of the stringed type and, more particularly, to a sound pickup designed to convert the vibrations of its strings into electrical signals.

BACKGROUND OF THE INVENTION

The instruments here contemplated, in which the strings have major vibratory portions in a plane generally parallel to the surface of a body such as a soundboard to which they are anchored under tension, include not only those of the neck type (guitars, violins etc.) but also pianos and the like. In such instruments it has already been proposed to provide electroacoustic pickups of the piezoelectric type (see, for example, U.S. Pat. Nos. 3,712,951, 3,530,228 and 3,049,958) as well as photoelectric transducers (U.S. Pat. No. 3,733,953). The use of a strain gauge in a vibraphone, xylophone or marimba has also been suggested (U.S. Pat. No. 3,684,814).

As disclosed in my above-identified copending application, a bridge member separating a set of strings from a resonant instrument body can be divided by slots into a number of sections each individually supporting a single string or a group of strings whose vibrations are to be picked up by one or two strain gauges carried on the respective section, the direction of maximum sensitivity of these strain gauges being perpendicular to the body surface and to the longitudinal direction of the strings. Such a strain gauge is highly sensitive to transverse vibrations of the strings but will not respond to oscillations of the resonant body at its various natural frequencies as induced in that body by the impinging sound waves. In another copending application, Ser. No. 123,443 filed Feb. 21, 1980 and now abandoned, I have disclosed circuitry particularly designed for the faithful reproduction of the resonance frequencies of such a body which generally lie in a range of up to about 5 KHz.

Aside from the periodically varying pressures exerted by a vibrating string upon a bridge or a section thereof perpendicular to the supporting body surface, however, there are also generated shear stresses parallel to that surface which result from the periodic changes in the effective length of the string (referred to in the art as "speaking length"). Since each transverse excursion of the string from its normal position foreshortens that effective length, these longitudinally oriented shear stresses have a periodicity which is twice that of the transverse vibrations giving rise thereto. Thus, the spectrum of the shear stresses is rich in even harmonics of the fundamental string frequency and its harmonics which, however, are not picked up by transversely oriented strain gauges. Theoretically, these even harmonics could be sensed by differentially connecting the outputs of a pair of strain gauges disposed on opposite parallel faces of a bridge section as disclosed in my prior application Ser. No. 935,916, yet this would require a careful balancing of the transverse forces acting upon these two faces.

OBJECTS OF THE INVENTION

An important object of my present invention, therefore, is to provide simple means for electromechanically picking up the various frequency components generated by the strings of a musical instrument with avoidance of objectionable cross-coupling.

A related object is to provide an effective mounting for a set of strain gauges serving as the pickup means.

SUMMARY OF THE INVENTION

In accordance with my present invention, the strings are supported on the instrument body by respective webs of hard elastic material, preferably a synthetic polymer, these webs being free to vibrate in a direction parallel to the major string portions in response to changes in effective length as discussed above. Each web is provided with a strain gauge whose direction of maximum sensitivity is inclined to the plane of the strings (and thus also to the confronting body surface) at an acute angle which preferably lies between about 30° and 60° and which at least approximates the angle of inclination of one of two planes of maximum shear stress in the web, namely a plane of maximum elongation and a plane of maximum compression.

As more fully disclosed hereinafter, these two planes intersect each other with opposite slopes, with the plane of elongation rising forwardly (i.e. in the direction of the speaking lengths of the strings) with each string resting on a ridge of a gable-shaped top of the associated web; the strain gauge could thus be mounted on either of the two sloping gable faces. For reasons that will become apparent hereinafter, however, it is generally more convenient to mount the strain gauge on the front face of the gable, thus at an angle of inclination approaching that of the plane of maximum compression.

BRIEF DESCRIPTION OF THE DRAWING

The above and other features of my invention will now be described in detail with reference to the accompanying drawing in which.

SPECIFIC DESCRIPTION

Figure 1:
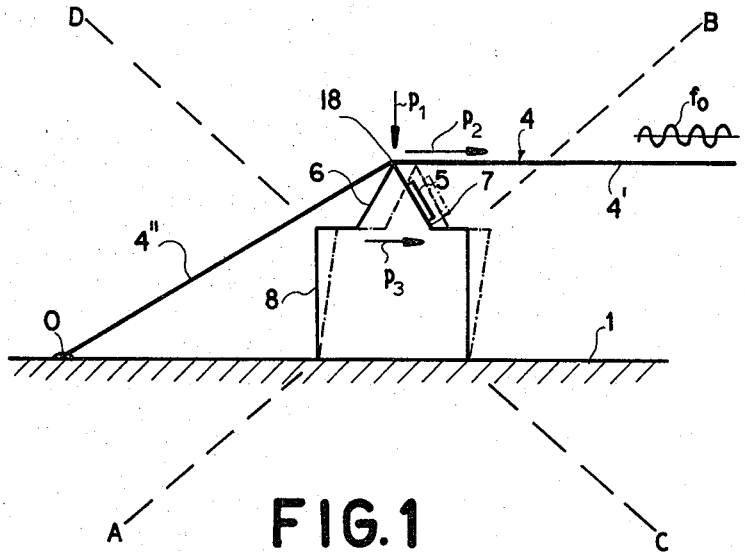
FIG. 1 is a somewhat diagrammatic side-elevational view serving to explain the principles underlying the present invention.

In FIG. 1 I have diagrammatically illustrated a soundboard 1, which may be part of the body of a neck-type string instrument such as a guitar, together with a string 4 anchored to that soundboard at a point O. A bridge section 8, firmly resting on the soundboard, supports the string 4 and divides it into a major, vibratory portion 4' and a minor, restrained portion 4''. The major portion 4', substantially paralleling the surface of board 1, defines the speaking length of the string.

The bridge section 8 is a web individual to string 4 (although, in principle, it could also support a group of strings tuned to the same fundamental frequency) and is provided with a gable-shaped top having sloping back and front faces 6 and 7 meeting at a ridge 18. The slope of rear face 6 is steeper than that of string section 4'' which is therefore separated from that face by a rake angle. The string 4 bears upon the ridge 18 under a pressure $p_1$ varying with the natural frequency $f_0$ of the string when the latter is set in vibration. This vibration also varies the longitudinal tension $p_2$ of string portion 4' but, as explained above, at a fundamental frequency $2f_0$; the higher harmonics of frequency $f_0$ also appear doubled in the variations of tension $p_2$. A part of these variations is absorbed by the tensile strength of string portion 4'', the remainder being translated into an alternating shear force $p_3$ acting upon the web 8. This web, accordingly, oscillates in the longitudinal direction of string portion 4' and thus undergoes a certain periodic deformation as indicated in phantom lines.

As the generally rectangular cross-section of web 8 assumes a substantially parallelogrammatic shape, its diagonals define two planes of maximum shear stress, namely a plane A-B of maximum elongation and a plane C-D of maximum compression. These stress planes include opposite angles of roughly 45° with the surface of board 1 and with the string plane substantially parallel thereto.

If the instrument body represented by soundboard 1 is of the usual hollow type, the shear stresses $p_3$ transmitted to it by the web 8 (and by similar bridge sections supporting the remaining strings) give rise to forced body oscillations termed camber-rocking vibrations. In view of the frequency doubling referred to above, these camber-rocking vibrations contain a higher proportion of even harmonics than corresponds to the frequency spectrum of the transversely vibrating string. The sound emitted by the instrument body, therefore, contains frequency components that can be acoustically perceived but that have no significant influence upon the conductivity of a strain gauge whose direction of maximum sensitivity is perpendicular to the board surface.

Thus, a strain gauge designed to detect these even harmonics for a faithful electronic reproduction of the sound pattern of the instrument must have a direction of sensitivity angularly offset from the bisectors of planes A-B and C-D, i.e. from the transverse and longitudinal stress directions $p_1$ and $p_2$. A choice of its angle of inclination, relative to board 1, determines the extent to which the variations of pressure $p_1$ and shear force $p_3$ are respectively translated into electrical oscillations, i.e. the ratio of the corresponding frequency components in the strain-gauge output. This angle will generally lie between about 30° and 60°.

Although a strain gauge could be mounted on a lateral face of web 8 in a manner satisfying this requirement, this would require a relatively wide spacing of adjacent bridge sections from one another. A more compact bridge structure, therefore, can be achieved by placing such a gauge 5 on one of the two sloping faces 6 and 7 of the web which roughly parallel the two stress planes A-B and C-D. With an arrangement as shown in FIG. 1, either one of these faces would be available for that purpose. In many instances, however, it will be desirable to provide more than point support for the string by eliminating the rake angle existing between its anchor portion 4'' and the back face 6, especially when the string consists of steel and is thus liable to cut into the ridge 18 in the presence of such a rake angle. The front face 7 then provides the most convenient location for the strain gauge 5 as illustrated in FIG. 1.

For proper operation it is, of course, necessary to guard against relative shifts of the string, the bridge and the soundboard. For this purpose it may be desirable to use a relatively massive bridge mount 2, FIG. 2, as conventionally employed with concert or "western" guitars. In this case the several strings 4 (only one shown) are anchored to the underlying instrument body 1 not directly but through the intermediary of a retaining ledge integral with that bridge mount. The bridge itself is formed as an insert 13 received in a groove of mount 2, this insert being formed with a number of cutouts 17 (FIG. 4) accommodating respective string-supporting webs **8*a*. If the insert 13 is molded from a suitable plastic material, e.g. a polyamide or a polycarbonate, the webs 8*a* may be integral therewith. Where the insert is metallic, I prefer to use a plastic web of a lower modulus of elasticity (e.g. about one hundredth that of metal) which is adhesively or otherwise secured at its base to the bottom of the respective cutout 17. The lateral clearances left between the web 8*a* and the sides of the cutout 17 may be somewhat wider than the string diameter, in which case the wings of insert 13 flanking the web 8*a* should be provided with overlying strips 12 forming projections 11 which closely approach the ridge 18*a* of the web to prevent the string 4 from accidentally entering either of these clearances. In order to facilitate the formation of the cutouts 17, the strips 12** should be separately produced and bonded to the upper edge of the insert.

Figure 2:
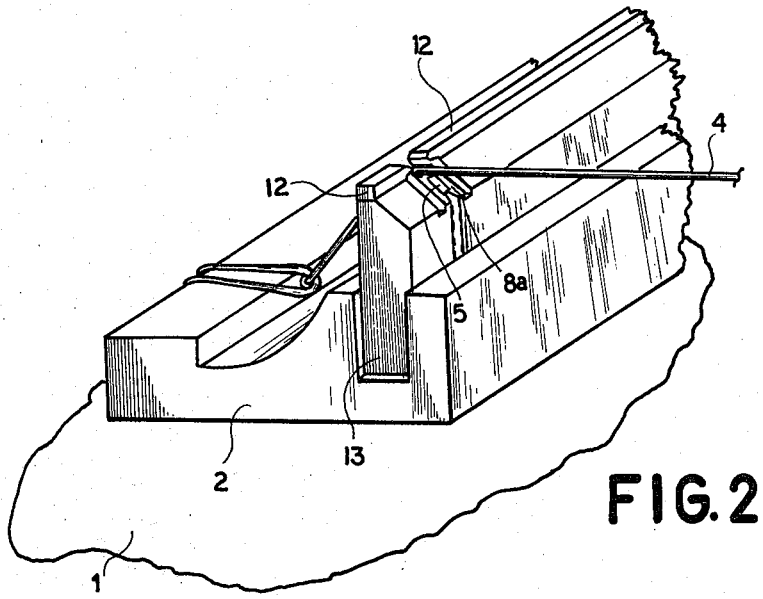
FIG. 2 is a perspective view of a portion of a musical instrument provided with a bridge according to my invention.
Figure 4B:
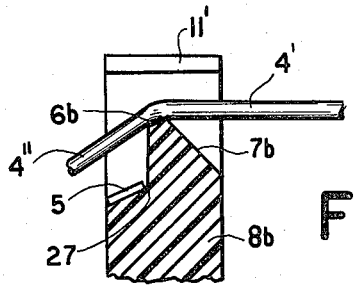
FIG. 4B is a cross-sectional view similar to FIG. 4A, showing another modification.
Figure 4:
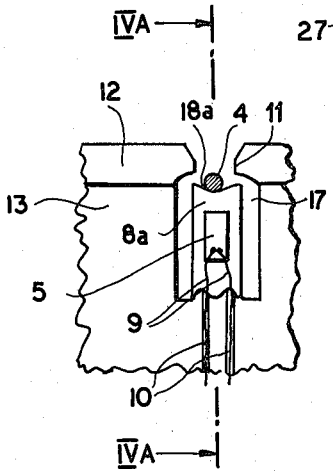
FIG. 4 is a fragmentary front view of the bridge shown in FIG. 2.
Figure 4A:
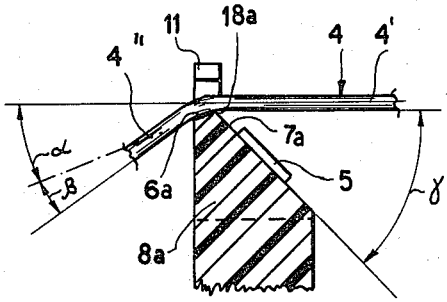
FIG. 4A is a cross-sectional view taken on the line IVA—IVA of FIG. 4.

The web **8*a* shown in FIGS. 2, 4 and 4A has a gabled top with sloping back and front faces 6*a* and 7*a*, the latter carrying a strain gauge 5 whose direction of sensitivity includes an angle $\gamma$ of roughly 45° with the string plane. The back face 6*a* is inclined to that plane at an angle $\alpha$ and in turn includes an angle $\beta<\alpha$ with the anchored string portion 4''. This string portion, accordingly, is bent at an obtuse supplemental angle $180°-\beta$ about the rear edge of face 6*a* and thus exerts less pressure upon that edge than is sustained by the ridge 18*a* about which the string is bent at a less obtuse angle $180°-\alpha$. This is desirable in order to transmit the greater part of the pressure changes to the gauge-carrying front face 7*a* which, it will be noted, is substantially larger in this instance than the string-supporting back face 6*a*. Leads 9 extending from strain gauge 5 are accommodated in channels 10 of insert 13 and, like the gauge 5** itself, are advantageously covered by a protective coating of epoxy resin or the like.

For firmer adherence of the string to the web face **6*a*, the latter may be provided with a friction-increasing layer of rosin, for example. Furthermore, face 6*a* is advantageously made slightly concave to form a groove designed to hold the string 4** in a centered position.

Figure 3:
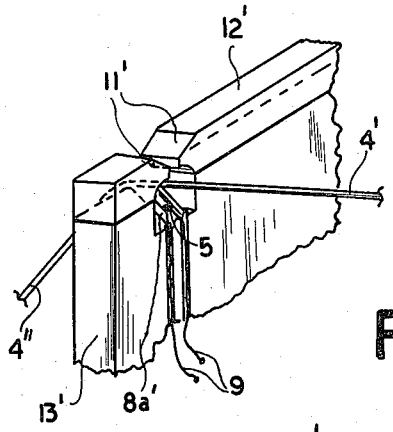
FIG. 3 is a fragmentary perspective view of a slightly modified bridge according to the invention.

Whereas the insert 13 of FIGS. 2, 4 and 4A has a beveled front surface substantially in line with the web faces *7a*, I may also use an insert 13' of rectangular cross-section as shown in FIG. 3. In that instance the protective strips 12' cemented to the insert have broader extremities 11' which, as shown in FIG. 4B, are coextensive in width with the several webs. The web **8*b* particularly illustrated in FIG. 4B differs from the aforedescribed web 8*a* by having a smaller front face 7*b* adjoining its back face 6*b* and by further having an inclined shelf 27 supporting the string gauge 5 at a suitable distance from the anchored strain portion 4''. In this instance it may be desirable to make the angle $\beta$ between string portion 4'' and face 6*b* somewhat larger than the angle of inclination $\alpha$ of that face. The slope of shelf 27** is of the same magnitude as angle $\gamma$, i.e. between about 30° and 60°.

Figure 5:
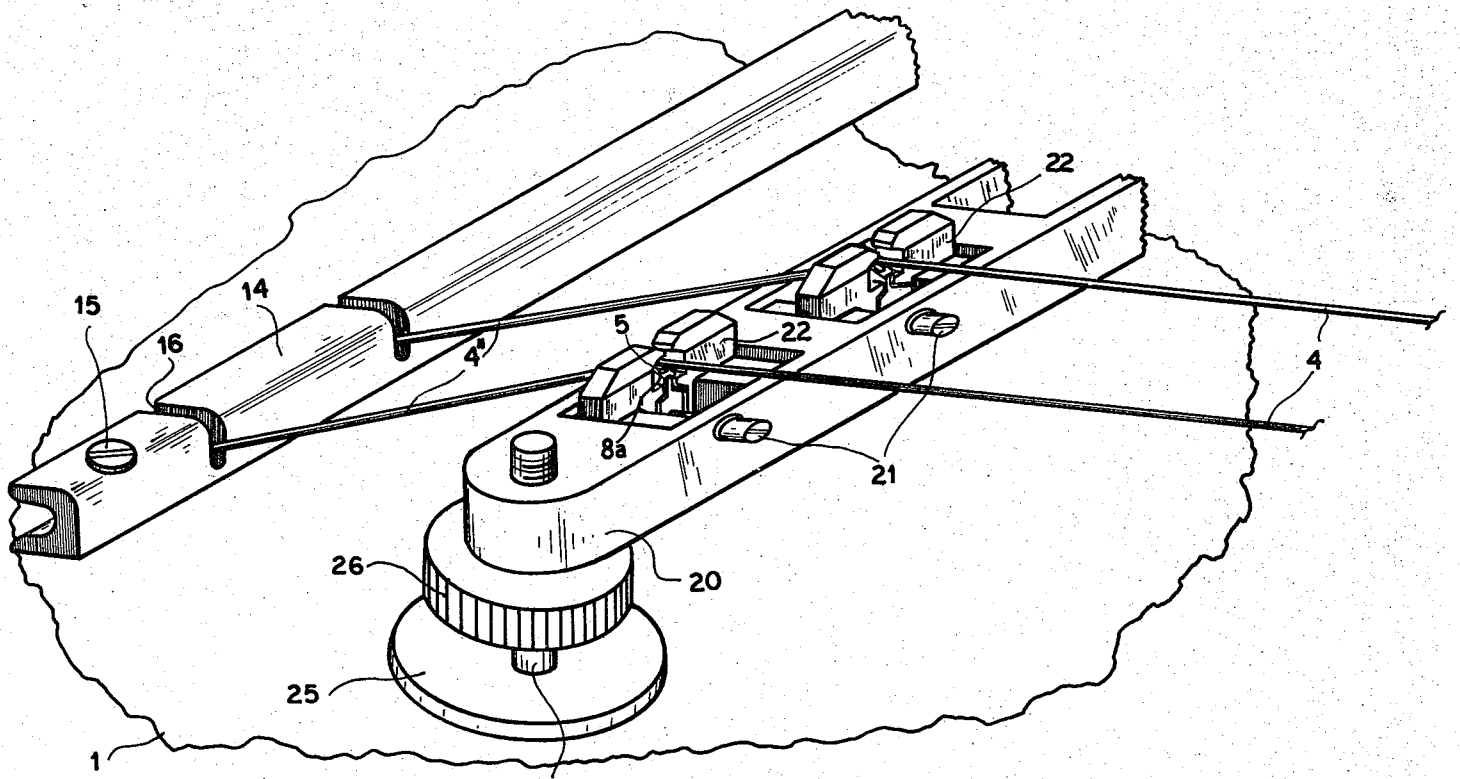
FIG. 5 is a fragmentary perspective view, similar to FIG. 2, illustrating another bridge structure embodying my invention.
Figure 6:
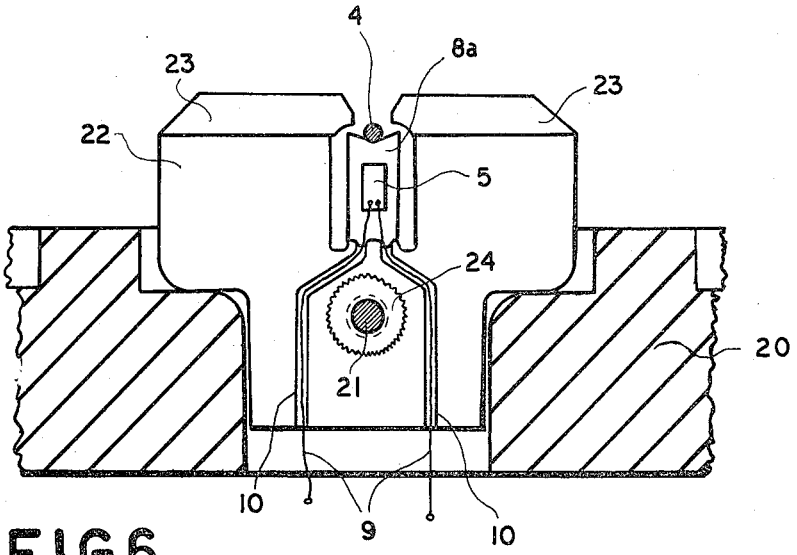
FIG. 6 is a front view of a detail of the bridge structure of FIG. 5, drawn to a larger scale.
Figure 7:
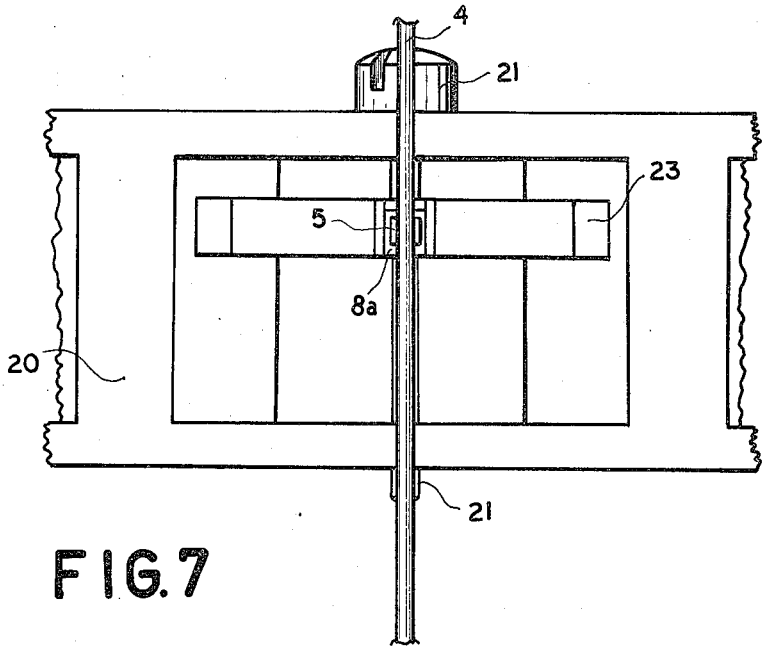
FIG. 7 is a top view of the bridge detail shown in FIG. 6.

In FIGS. 5–7 I have illustrated, by way of further example, a bridge construction of a type used with some electric guitars in which a frame 20 has cutouts accommodating respective bridge sections 22 whose positions relative to the frame are adjustable with the aid of bolts 21 for the tuning of the corresponding strings 4. The rear ends of string portions 4'' are anchored to the instrument body 1 by being received in slots 16 of a mounting strip 14 which is secured to that body by screws 15 (only one shown). The frame 20 is provided with rotatable feet 25 having threaded stems 19 engaged by locking nuts 26 to facilitate adjustment of the effective height of the bridge sections above the body surface. Each bridge section 22, as seen in FIG. 6, is provided with an internally threaded metal sleeve 24 engaged by the respective tuning bolt 21. FIG. 6 also shows that the frame 20 may be made of metal whereas the bridge element 22, overlain by protective strips 23, could consist either of synthetic resin or of metal; thus, the string-supporting webs **8*a* of suitable polymeric material may be either integral with these bridge sections or adhesively secured thereto, as discussed above. Leads 9 extending from each strain gauge 5 are again received in channels 10 here formed in the individual bridge sections 22**.

It will be understood that my present invention, though particularly illustrated for a variety of guitars, is applicable to string instruments in general including violins, violas, cellos, pianos, harpsichords and the like.

I claim:

1. A musical instrument comprising:

an instrument body;

a plurality of strings anchored under tension to said body while extending with major portions of their length in a plane generally parallel to a surface of said body;

support means on said surface holding said strings separated from said body, said support means including a plurality of webs of hard elastic material engaged by respective strings under a pressure transverse to said plane, said webs being free to vibrate in a direction parallel to said major portions in response to changes in the effective lengths of the respective strings; and transducer means for converting vibrations of said strings into electrical signals, said transducer means including a plurality of strain gauges respectively disposed on said webs with a direction of maximum sensitivity inclined to said plane at an acute angle.

2. An instrument as defined in claim 1 wherein said webs are provided with gabled tops having sloping front and back faces separated by ridges in contact with said strings, each of said strain gauges being mounted on one of said sloping faces.

3. An instrument as defined in claim 2 wherein said strings have anchor portions in contact with said back faces, and bent at an obtuse angle about rear edges of the latter, said strain gauges being mounted on said front faces.

4. An instrument as defined in claim 3 wherein the supplement of said obtuse angle is less than the slope angle included between said back faces and said plane whereby said ridges are more strongly loaded than said rear edges by the respective strings.

5. An instrument as defined in claim 2 wherein said ridges are concave to form shallow grooves receiving said strings.

6. An instrument as defined in claim 2, 3, 4 or 5 wherein said webs have bases rigidly joined to a bridge member resting on said surface, said bridge member having wings flanking said webs with narrow lateral clearances.

7. An instrument as defined in claim 6 wherein the width of said clearances exceeds the thickness of a string, said wings being provided with projections overhanging said grooves with intervening gaps less than a string thickness.

8. An instrument as defined in claim 1, 2, 3, 4 or 5 wherein said acute angle lies between substantially 30° and 60°.

9. An instrument as defined in claim 1, 2, 3, 4 or 5 wherein said elastic material is a synthetic polymer.

* * * * *